US010099340B2

(12) United States Patent
Motoshima

(10) Patent No.: US 10,099,340 B2
(45) Date of Patent: Oct. 16, 2018

(54) POLISHING APPARATUS INCLUDING PAD CONTACT MEMBER WITH BAFFLE IN LIQUID FLOW PATH THEREIN

(71) Applicant: Ebara Corporation, Tokyo (JP)

(72) Inventor: Yasuyuki Motoshima, Tokyo (JP)

(73) Assignee: Ebara Corporation, Tokyo (JP)

( * ) Notice: Subject to any disclaimer, the term of this patent is extended or adjusted under 35 U.S.C. 154(b) by 16 days.

(21) Appl. No.: 15/297,307

(22) Filed: Oct. 19, 2016

(65) Prior Publication Data

US 2017/0106492 A1 Apr. 20, 2017

(30) Foreign Application Priority Data

Oct. 20, 2015 (JP) ..... 2015-206064

(51) Int. Cl.

| | |
|---|---|
| ***B24B 37/015*** | (2012.01) |
| ***B24B 37/20*** | (2012.01) |
| ***B24B 49/14*** | (2006.01) |
| ***B24B 55/02*** | (2006.01) |

(52) U.S. Cl.

CPC ..... *B24B 37/015* (2013.01); *B24B 37/20* (2013.01); *B24B 49/14* (2013.01); *B24B 55/02* (2013.01)

(58) Field of Classification Search

CPC ..... B24B 37/015; B24B 49/14; B24B 55/02; B24B 55/03; G01J 2005/0085

See application file for complete search history.

(56) References Cited

U.S. PATENT DOCUMENTS

| | | | | |
|---|---|---|---|---|
| 7,837,534 | B2 * | 11/2010 | Aiyoshizawa | B24B 55/02 451/287 |
| 8,845,391 | B2 * | 9/2014 | Sone | B24B 37/015 451/41 |
| 9,475,167 | B2 * | 10/2016 | Maruyama | B24B 37/04 |
| 9,782,870 | B2 * | 10/2017 | Maruyama | B24B 37/015 |
| 2008/0311823 | A1 * | 12/2008 | Aiyoshizawa | B24B 37/015 451/7 |
| 2011/0159782 | A1 * | 6/2011 | Sone | B24B 37/015 451/7 |
| 2012/0220196 | A1 * | 8/2012 | Maruyama | B24B 37/015 451/7 |
| 2014/0364040 | A1 * | 12/2014 | Sone | B24B 37/015 451/7 |

(Continued)

FOREIGN PATENT DOCUMENTS

JP 2012-176449 A 9/2012

*Primary Examiner* — Timothy V Eley

(74) *Attorney, Agent, or Firm* — Abelman, Frayne & Schwab

(57) ABSTRACT

Disclosed is a polishing apparatus that polishes a substrate by causing the substrate to be in slide contact with a polishing pad. The polishing apparatus includes a pad temperature control mechanism configured to control a surface temperature of the polishing pad, which includes a pad contact member that comes in contact with the surface of the polishing pad and a liquid supply system configured to supply a temperature-controlled liquid to the pad contact member. The pad contact member includes a liquid flow path therein, and the liquid flow path communicates with a liquid inlet and a liquid outlet connected to the liquid supply system. At least one planar baffle is disposed in the liquid flow path, and the baffle has a space therein.

14 Claims, 15 Drawing Sheets

(56) References Cited

U.S. PATENT DOCUMENTS

| | | | | |
|---|---|---|---|---|
| 2015/0079881 | A1* | 3/2015 | Maruyama | B24B 37/015 451/53 |
| 2017/0232572 | A1* | 8/2017 | Brown | B24B 37/015 451/5 |
| 2017/0239778 | A1* | 8/2017 | Maruyama | B24B 37/015 |
| 2017/0361420 | A1* | 12/2017 | Maruyama | G01J 5/025 |

* cited by examiner

POLISHING APPARATUS INCLUDING PAD CONTACT MEMBER WITH BAFFLE IN LIQUID FLOW PATH THEREIN

CROSS-REFERENCE TO RELATED APPLICATIONS

This application is based on and claims priority from Japanese Patent Application No. 2015-206064, filed on Oct. 20, 2015, with the Japan Patent Office, the disclosure of which is incorporated herein in its entirety by reference.

TECHNICAL FIELD

The present disclosure relates to a polishing apparatus that polishes a substrate such as, for example, a semiconductor wafer, by causing the substrate to be in slide contact with a polishing pad. In particular, the present disclosure relates to a polishing apparatus that polishes a substrate while regulating the surface temperature of the polishing pad.

BACKGROUND

According to high integration and high densification of semiconductor devices, a circuit wiring has recently been gradually further microfabricated, and the number of layers of multi-layered wirings has also gradually increased. When it is intended to implement multi-layered wirings while achieving the microfabrication of a circuit, a step is increased following the unevenness on the surface of an under layer. Thus, a film coatability for a step shape (step coverage) is deteriorated in forming a thin film as the number of wiring layers is increased. Accordingly, in order to form multi-layered wirings, it is necessary to improve the step coverage, and perform a flattening treatment in a proper process. In addition, because a focal depth becomes swallower as fineness is improved in optical lithography, it is necessary to perform a flattening treatment on the surface of a semiconductor device in order to ensure that a concavo-convex level difference on the surface of the semiconductor device does not exceed the focal depth.

Accordingly, flattening techniques of the surface of a semiconductor device have become increasingly important in a manufacturing process of the semiconductor device. Among the flattening techniques, the most important technique is a chemical mechanical polishing (CMP). The CMP performs polishing using a polishing apparatus by causing a substrate (e.g., a semiconductor wafer) to be in slide contact with a polishing pad while supplying a polishing liquid (slurry) containing abrasive grains of silica ($SiO_2$), ceria ($CeO_2$), or the like to the polishing pad.

A CMP apparatus is used in a process of polishing the surface of a substrate in manufacturing a semiconductor device. The CMP apparatus polishes the surface of the substrate by holding and rotating the substrate by a top ring, and pushing the substrate against a polishing pad on a rotating polishing table. During the polishing, a polishing liquid (slurry) is supplied to the polishing pad, and the surface of the substrate is flattened by the chemical action of the polishing liquid and the mechanical action of the abrasive grains contained in the polishing liquid.

The polishing rate of the substrate also relies on the surface temperature of the polishing pad in addition to the polishing load of the substrate with respect to the polishing pad. This is because the chemical action of the polishing liquid for the substrate relies on the temperature. Accordingly, in manufacturing a semiconductor device, it becomes important to keep the surface temperature of the polishing pad at an optimum value during the polishing of the substrate in order to increase the polishing rate of the substrate and keep the polishing rate of the substrate more uniformly.

For that reason, in Japanese Patent Laid-Open Publication No. 2012-176449, the assignee of the present application previously proposed a polishing apparatus that is provided with a pad temperature control mechanism that controls the surface temperature of a polishing pad by supplying a temperature-controlled liquid to a pad contact member that comes in contact with the surface of the polishing pad.

The pad contact member proposed in Japanese Patent Laid-Open Publication No. 2012-176449 is formed in a planar body having a liquid flow path therein, and a plurality of baffles is arranged in the liquid flow path within the planar body to form a zigzag flow path. The pad contact member is formed of a material having a high thermal conductivity (e.g., silicon carbide (SiC)) in order to transfer heat from the temperature-controlled liquid flowing in the liquid flow path to the surface of the polishing pad as much as possible without causing the waste of heat.

SUMMARY

According to one aspect of the present disclosure, there is provided a polishing apparatus that polishes a substrate by causing the substrate to be in slide contact with a polishing pad. The polishing apparatus includes: a polishing table configured to support the polishing pad; a top ring configured to press the substrate against the polishing pad on the polishing table; and a pad temperature control mechanism configured to control a surface temperature of the polishing pad. The pad temperature control mechanism includes a pad contact member that comes in contact with the surface of the polishing pad and a liquid supply system configured to supply a temperature-controlled liquid to the pad contact member. The pad contact member includes a liquid flow path therein, and the liquid flow path communicates with a liquid inlet and a liquid outlet connected to the liquid supply system. At least one planar baffle is disposed in the liquid flow path, and the baffle has a space therein.

The foregoing summary is illustrative only and is not intended to be in any way limiting. In addition to the illustrative aspects, embodiments, and the features described above, further aspects, embodiments, and features will become apparent by reference to the drawings and the following detailed description.

BRIEF DESCRIPTION OF THE DRAWINGS

FIGS. 9A and 9B are views illustrating a pad contact member of a comparative example and a pad contact member of the present disclosure in comparison, in which FIG. 9A is a schematic view illustrating a pad contact member of the comparative example, and FIG. 9B is a schematic view illustrating the pad contact member of the present disclosure illustrated in FIGS. 3 to 6.

DETAILED DESCRIPTION

In the following detailed description, reference will be made to the accompanying drawings, which form a part hereof. The exemplary embodiments described in the detailed description, drawings, and claims are not meant to be limiting. Other embodiments may be utilized, and other changes may be made without departing from the spirit or scope of the subject matter presented here.

The inventor of the present application obtained the following results in the process of repeatedly performing a step of controlling the surface temperature of a polishing pad using a pad contact member that is provided with a baffle in a liquid flow path, as described in Japanese Patent Laid-Open Publication No. 2012-176449.

Figure 17:
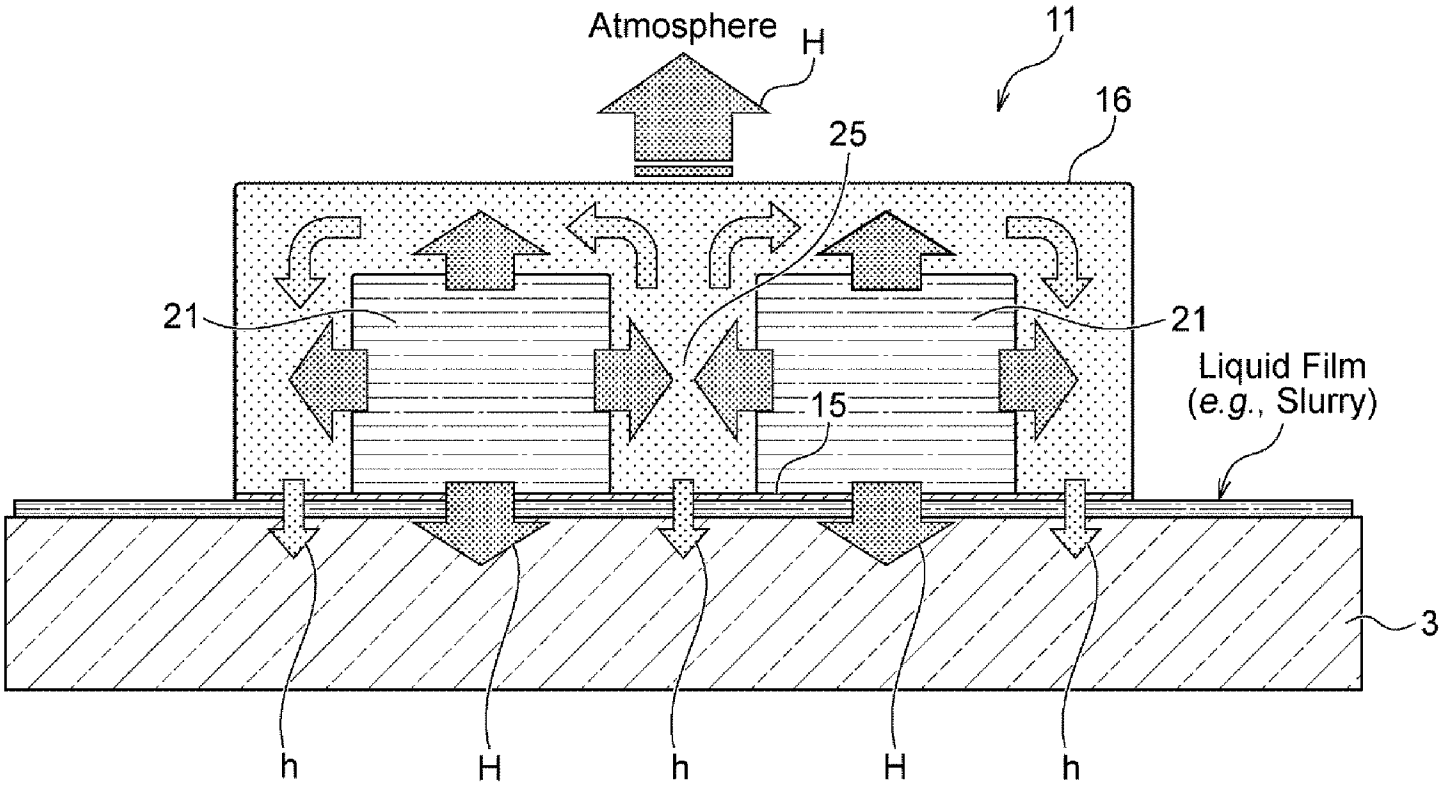
FIG. 17 is a schematic view illustrating a flow state of heat when the surface temperature of a polishing pad is controlled using a pad contact member that is provided with baffles in a liquid flow path.

FIG. 17 is a schematic view illustrating a flow state of heat when the surface temperature of a polishing pad 3 is controlled using a pad contact member 11 that is provided with baffles in a liquid flow path. A liquid film (e.g., slurry) is interposed between the pad contact member 11 and the polishing pad 3. As illustrated in FIG. 17, the pad contact member 11 includes a plate member 15 having a contact surface that comes in contact with the surface of the polishing pad 3, and a flow path forming member 16 having a liquid flow path formed therein. A liquid flow path 21 is formed within the pad contact member 11, and a baffle 25 is disposed within the liquid flow path 21. The heat retained by the liquid flowing in the liquid flow paths 21 flows in four directions around each of the liquid flow paths 21 as indicated by thick arrows, and the heat, which has flown downward from the liquid flow paths 21, contributes to the temperature control of the polishing pad 3 by being transferred to the polishing pad 3 from the bottom surface of the plate member 15 as indicated by thick arrows H. Meanwhile, the heat, which has flown left and right from the liquid flow paths 21, flows to the side walls of the flow path forming member 16 and the baffle 25, and the heat, which has flown upward from the liquid flow paths 21, flows to the upper wall of the flow path forming member 16. In addition, the heats, which have flown to the side walls and the upper wall of the flow path forming member 16, and the baffle 25, flow in the side walls, the upper wall, and the baffle 25, respectively, and a part of the heats is transferred from the bottom surface of the plate member 15 to the polishing pad 3 as indicated by thin arrows h. In addition, a part of the heats moves to the liquid within the next flow path through the baffle 25, and a part of the heats is discharged to the atmosphere from the outer wall face of the flow path forming member 16 as indicated by the thick arrow H.

As can be seen from the heat flows illustrated in FIG. 17, a part of the heats, which have flown to the baffle 25 from the liquid flow paths 21, is used for controlling the temperature of the polishing pad 3, but the remaining of the heats moves to the liquid within the next flow path through the baffle 25 or is discharged to the atmosphere from the outer wall face of the pad contact member 11, and thus, is not used for controlling the temperature of the polishing pad 3.

In addition, the pad contact member 11 may be configured to completely separate two flow paths of a relatively hot liquid flow path in which a relatively hot liquid flows and a relatively cold liquid flow path in which a relatively cold liquid flows from each other by a baffle (or a partition). However, such a pad contact member has a problem in that the heat of the relatively hot liquid flowing in the relatively hot liquid flow path flows to the relatively cold liquid flowing in the relatively cold liquid flow path through the baffle so that the heat of the relatively hot liquid is lost to the relatively cold liquid.

Figure 18:
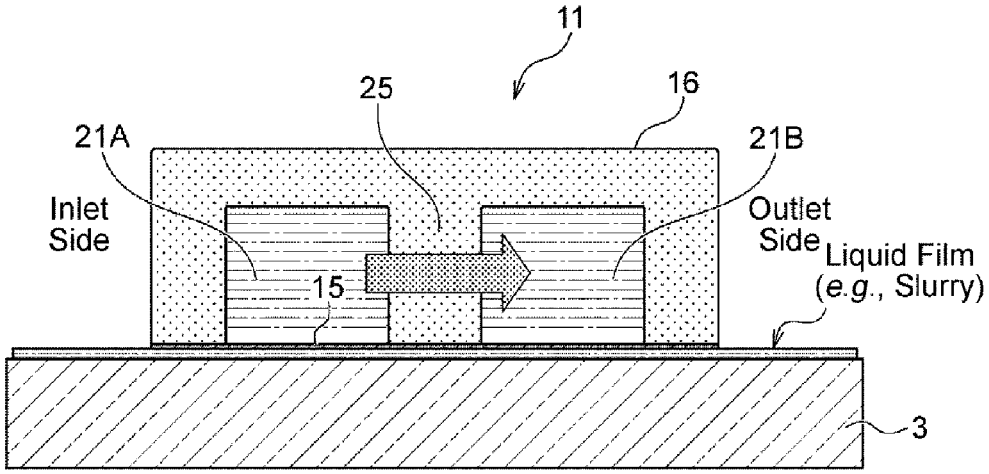
FIG. 18 is a schematic view illustrating a flow state of heat when the surface temperature of a polishing pad is controlled using a pad contact member in which two flow paths of a relatively hot liquid flow path in which a relatively hot liquid flows and a relatively cold liquid flow path in which a relatively cold liquid flows are completely separated from each other by a baffle (or a partition).

FIG. 18 is a schematic view illustrating a flow state of heat when the surface temperature of a polishing pad 3 is controlled using a pad contact member 11 in which two flow paths of a relatively hot liquid flow path in which a relatively hot liquid flows and a relatively cold liquid flow path in which a relatively cold liquid flows are completely separated from each other by a baffle (or a partition). A liquid film (e.g., slurry) is interposed between the pad contact member 11 and the polishing pad 3. As illustrated in FIG. 18, two flow paths of a relatively hot liquid flow path 21A in which a relatively hot liquid flows and a relatively cold liquid flow path 21B in which a relatively cold liquid flows are arranged within the pad contact member 11. The relatively hot liquid flow path 21A and the relatively cold liquid flow path 21B are completely separated from each other by a baffle (or a partition) 25. In addition, in each of the relatively hot liquid flow path 21A and the relatively cold liquid flow path 21B, baffles (not illustrated) are arranged to form a zigzag flow path. As illustrated in FIG. 18, the heat retained by the relatively hot liquid flowing in the relatively hot liquid flow path 21A flows to the relatively cold liquid flowing in the relatively cold liquid flow path 21B as indicated by an arrow. That is, there is a problem in that the heat of the relatively hot liquid flowing in the relatively hot liquid flow path 21A is lost to the relatively cold liquid flowing in the relatively cold liquid flow path 21B, and thus is wasted.

The inventors have found that, in the pad contact member 11 illustrated in FIG. 17, a considerable amount of the heat flowing from the liquid flow paths 21 to the baffle 25 moves to the liquid within the next flow path without being used in the temperature control of the polishing pad 3 or is discharged to the atmosphere, and as a result, the heat is wasted. In addition, the inventors have found that, in the case of the pad contact member 11 including two or more flow paths therein as illustrated in FIG. 18, the heat of the relatively hot liquid flowing in the relatively hot liquid flow path 21A flows to the relatively cold liquid flowing in the relatively cold liquid flow path 21B through the baffle 25 such that the heat of the relatively hot liquid is lost to the relatively cold liquid, and as a result, the heat is wasted.

The present disclosure was made in consideration of the problems described above, and is to provide a polishing apparatus that controls the surface temperature of a polishing pad by a pad contact member that is provided with a baffle (or a partition) in a liquid flow path therein, in which the surface temperature of the polishing pad is controlled by efficiently transferring the heat retained by a liquid flowing in the liquid flow path of the pad contact member to the polishing pad without wasting the heat, thereby improving a polishing rate.

In order to achieve the above-described object, the polishing apparatus of the present disclosure polishes a substrate by causing the substrate to be in slide contact with a polishing pad. The polishing apparatus includes: a polishing table configured to support the polishing pad; a top ring configured to press the substrate against the polishing pad on the polishing table; and a pad temperature control mechanism configured to control a surface temperature of the polishing pad. The pad temperature control mechanism includes a pad contact member that comes in contact with the surface of the polishing pad and a liquid supply system configured to supply a temperature-controlled liquid to the pad contact member. The pad contact member includes a liquid flow path therein, and the liquid flow path communicates with a liquid inlet and a liquid outlet connected to the liquid supply system. At least one planar baffle is disposed in the liquid flow path, and the baffle has a space therein.

According to the present disclosure, in a pad contact member including at least one planar baffle disposed within a liquid flow path, it is possible to suppress heat from moving between adjacent flow paths across the baffle therebetween, thereby suppressing the unnecessary movement of heat.

According to an aspect of the present disclosure, the space communicates with a surrounding atmosphere of the pad contact member.

According to the present disclosure, because the inside of the housing of the polishing apparatus is filled with air, the space within the baffle is filled with air. The air within the space of the baffle forms a heat insulation layer, and as a result, heat can be suppressed from moving between adjacent flow paths across the baffle therebetween, thereby suppressing unnecessary movement of heat.

According to an aspect of the present disclosure, the space is a closed space. According to an aspect of the present disclosure, the closed space is a vacuum.

According to an aspect of the present disclosure, the vacuum within the closed space of the baffle may form a heat insulation layer so as to suppress heat from moving between the adjacent flow paths across the baffle, thereby suppressing the unnecessary movement of heat.

According to an aspect of the present disclosure, a gas is enclosed in the closed space.

According to an aspect of the present disclosure, the gas within the closed space of the baffle may form a heat insulation layer so as to suppress heat from moving between adjacent flow paths across the baffle interposed therebetween, thereby suppressing the unnecessary movement of heat. An example of the gas within the closed space of the baffle may be air.

According to an aspect of the present disclosure, the at least one baffle is a plurality of baffles that is arranged in parallel with each other.

According to an aspect of the present disclosure, the at least one baffle is a plurality of baffles that is alternately staggered from each other, and the liquid flow path is formed in a zigzag flow path by the plurality of baffles.

According to an aspect of the present disclosure, the pad contact member includes two or more liquid flow path, liquids flowing in the two or more liquid flow paths are controlled to have different temperatures, respectively, and the at least one baffle is disposed to separate the two or more liquid flow paths.

According to the present disclosure, in a pad contact member including two or more flow paths including a relatively hot liquid flow path and a relatively cold liquid flow path which are completely separated by a baffle (or a partition), it is possible to suppress heat from moving from the relatively hot liquid to the relatively cold liquid, thereby suppressing the unnecessary movement of heat.

According to the present disclosure, the pad contact member includes a member configured to suppress heat dissipation caused by radiation from an outer surface of the pad contact member.

In the present disclosure, the member configured to suppress the heat dissipation caused by radiation may be a foil of a metal having a low emissivity (e.g., aluminum).

According to an aspect of the present disclosure, the pad temperature control mechanism further includes a lifting mechanism configured to move the pad contact member up and down, and a moving mechanism configured to move the pad contact member between a predetermined raised position above the polishing pad and a predetermined retracted position radially outside the polishing table.

The present disclosure exhibits the following effects.

1) In a pad contact member including at least one planar baffle disposed within a liquid flow path, it is possible to suppress heat from moving between adjacent flow paths across the baffle, thereby suppressing the unnecessary movement of heat. Accordingly, it is possible to control the surface temperature of the polishing pad by transferring the heat retained by the liquid flowing in the liquid flow path of the pad contact member to the polishing pad without wasting the heat.

2) In a pad contact member including two or more flow paths including a relatively hot liquid flow path and a relatively cold liquid flow path which are completely separated by a baffle (or a partition), it is possible to suppress heat from moving from the relatively hot liquid to the relatively cold liquid, thereby suppressing the unnecessary movement of heat. Accordingly, it is possible to control the surface temperature of the polishing pad by transferring the heat retained by the liquid flowing in the liquid flow path of the pad contact member to the polishing pad without wasting the heat.

3) Because the heat retained by the liquid flowing in the liquid flow path of the pad contact member can be efficiently transferred to the polishing pad, it is possible to control the surface temperature of the polishing pad to a temperature that is optimum for polishing. Accordingly, a polishing rate can be improved.

Hereinafter, an exemplary embodiment of a polishing apparatus according to the present disclosure will be described with reference to FIGS. 1 to 16B. In FIGS. 1 to 16B, the same or corresponding elements will be denoted by the same reference numerals, and duplicate descriptions will be omitted.

Figure 1:
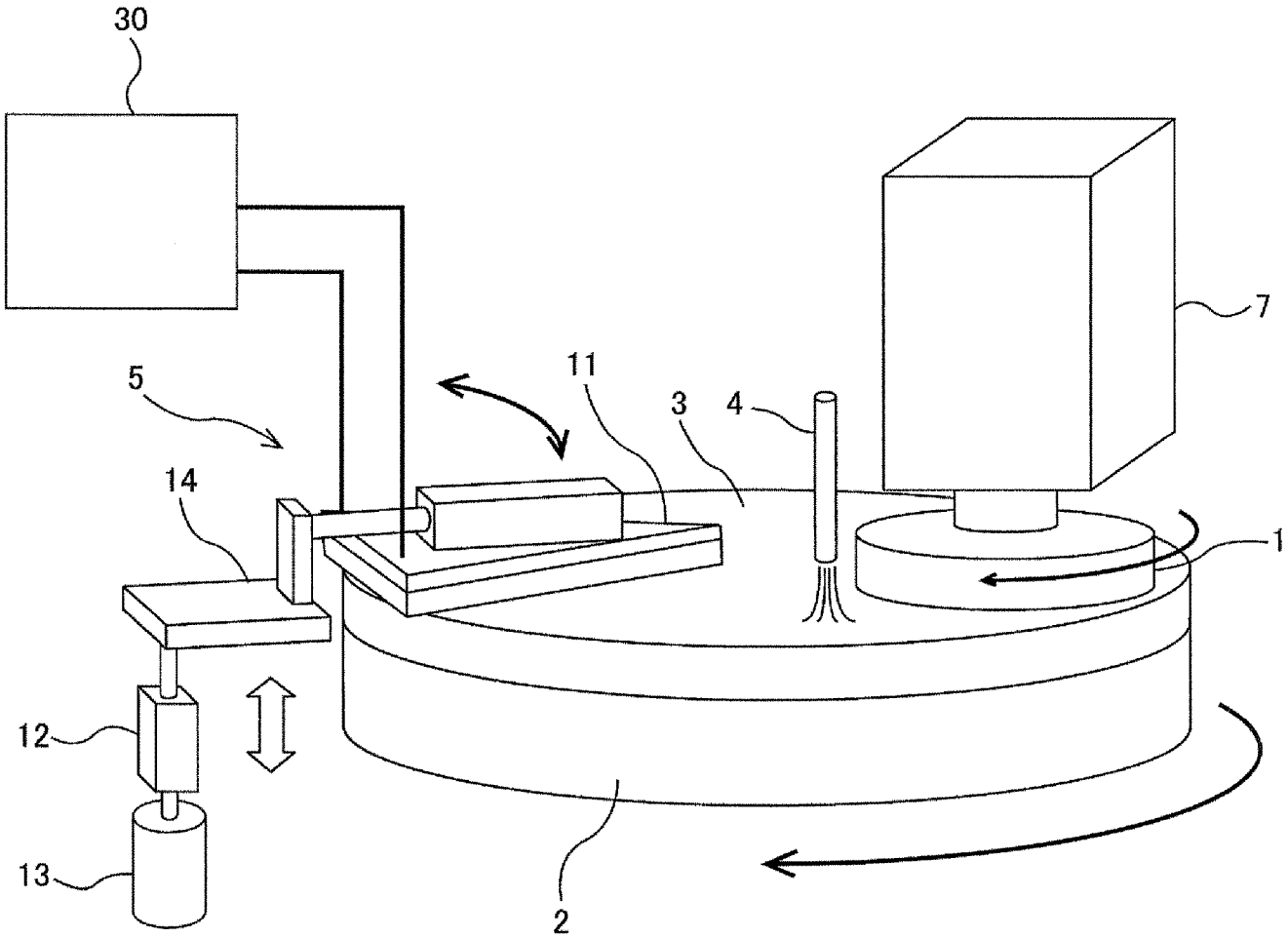
FIG. 1 is a schematic view illustrating a polishing apparatus according to an exemplary embodiment of the present disclosure.

FIG. 1 is a schematic view illustrating a polishing apparatus according to an exemplary embodiment of the present disclosure. As illustrated in FIG. 1, the polishing apparatus includes a top ring 1 configured to hold and rotate a substrate (e.g., a semiconductor wafer), a polishing table 2 configured to support a polishing pad 3, a polishing liquid supply mechanism 4 configured to supply a polishing liquid (e.g., slurry) to the surface of the polishing pad 3, and a pad temperature control mechanism 5 configured to control the surface temperature of the polishing pad 3.

The top ring 1 is supported on a polishing head support arm 7. An air cylinder and a motor (not illustrated) are disposed in the polishing head support arm 7, in which the top ring 1 is moved in the vertical direction and rotated around the axis thereof by the air cylinder and the motor. A substrate is held on the bottom surface of the top ring 1 by, for example, vacuum suction. A motor (not illustrated) is connected to the polishing table 2 which is configured to rotate in a direction indicated by an arrow.

The substrate to be polished is held by the top ring 1, and further rotated by the top ring 1. Meanwhile, the polishing pad 3 is rotated around the axis thereof together with the polishing table 2. In this state, a polishing liquid is supplied to the surface of the polishing pad 3 from the polishing liquid supply mechanism 4, and further, the surface of the substrate is pressed against the surface of the polishing pad 3 (i.e., a substrate polishing surface) by the top ring 1. The surface of the substrate is polished by the slide contact between the polishing pad 3 and the substrate under the existence of the polishing liquid.

The pad temperature control mechanism 5 includes a pad contact member 11 configured to come in contact with the surface of the polishing pad 3, and a liquid supply system 30 configured to supply a temperature-controlled liquid to the pad contact member 11. The pad contact member 11 is connected, through an arm 14, to an air cylinder 12 serving as a lifting mechanism that moves the pad contact member 11 up and down. In addition, the pad contact member 11 is connected to a motor 13 serving as a moving mechanism, and is moved by the motor 13 between a predetermined raised position above the polishing pad 3 and a predetermined retracted position radially outside the polishing table 2.

Figure 2:
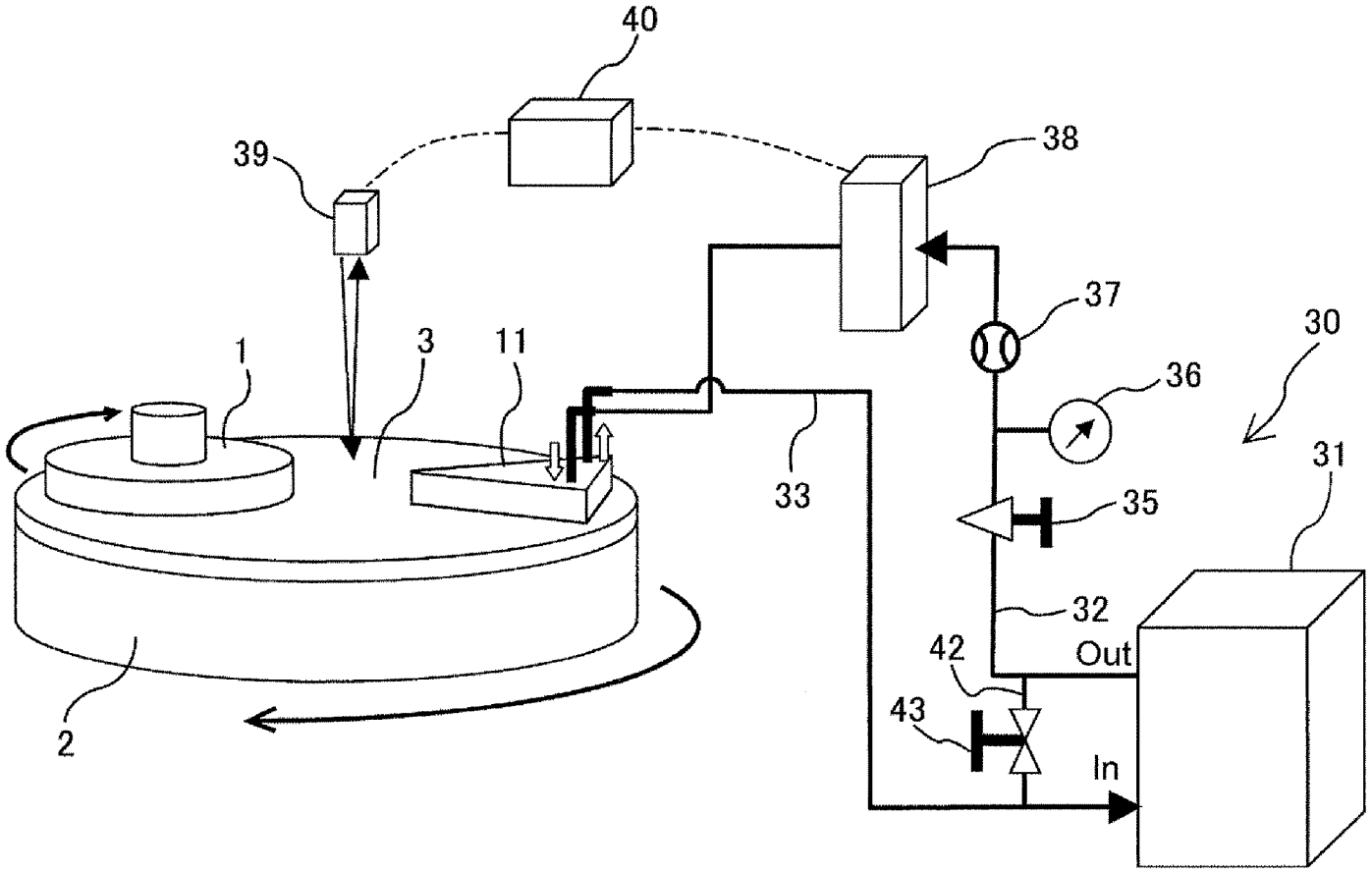
FIG. 2 is a schematic view illustrating a liquid supply system for supplying a liquid to a pad contact member.

FIG. 2 is a schematic view illustrating a liquid supply system 30 for supplying a liquid to the pad contact member 11. The liquid supply system 30 includes a liquid supply tank 31, and also includes a supply line 32 and a return line 33 that interconnect the liquid supply tank 31 and the pad contact member 11. The liquid serving as a heat medium is supplied to the pad contact member 11 from the liquid supply tank 31 via the supply line 32, and returned to the liquid supply tank 31 from the pad contact member 11 via the return line 33. In this way, the liquid circulates between the liquid supply tank 31 and the pad contact member 11. The liquid supply tank 31 includes a heater (not illustrated) configured to heat the liquid, and the liquid is heated to a predetermined temperature by the heater. That is, the liquid supply tank 31 functions as a temperature controller.

The liquid supply system 30 includes: a regulator 35 configured to make the pressure of the liquid flowing in the supply line 32 constant; a pressure gauge 36 configured to measure the pressure of the liquid passing through the regulator 35; a flow rate meter 37 configured to measure the flow rate of the liquid passing through the regulator 35; a flow rate control valve 38 configured to control the flow rate of the liquid supplied to the pad contact member 11; a radiation thermometer 39 serving as a pad surface thermometer configured to measure the surface temperature of the polishing pad 3; and a temperature controller 40 configured to control the flow rate control valve 38 based on the pad surface temperature measured by the radiation thermometer 39. While the supply line 32 and the return line 33 are communicated with each other through a communication line 42, the communication line 42 is normally closed by a hand valve 43.

The radiation thermometer 39 measures the surface temperature of the polishing pad 3 in a non-contact manner, and sends the measured value to the temperature controller 40. The temperature controller 40 controls the flow rate control valve 38 based on the measured value of the surface temperature of the polishing pad 3 in such a manner in which the surface temperature of the polishing pad 3 becomes a preset target temperature. The flow rate control valve 38 is operated based on a control signal from the temperature controller 40 so as to control the flow rate of the liquid supplied to the pad contact member 11. The surface temperature of the polishing pad 3 is controlled by the heat exchange between the liquid flowing in the pad contact member 11 and the polishing pad 3.

With the feedback control, the surface temperature of the polishing pad 3 is maintained at a predetermined target temperature. As the temperature controller 40, a proportional-integral-derivative (PID) controller may be used. The target temperature of the polishing pad 3 is determined according to the type or the polishing process of the substrate, and the determined target temperature is input to the temperature controller 40 in advance.

As described above, the surface temperature of the polishing pad 3 is controlled by controlling the flow rate of the liquid supplied to the pad contact member 11. As for the liquid (heat medium) supplied to the pad contact member 11, water is used. The water is heated by a heater of the liquid supply tank 31 to become hot-water having a temperature of, for example, 80° C. In a case where the surface temperature of the polishing pad 3 is raised more rapidly, silicone oil may be used as a heat medium. In the case where the silicone oil is used, the silicone oil is heated by the heater of the liquid supply tank 31 to 100° C. or higher (e.g., about 120° C.).

Figure 3:
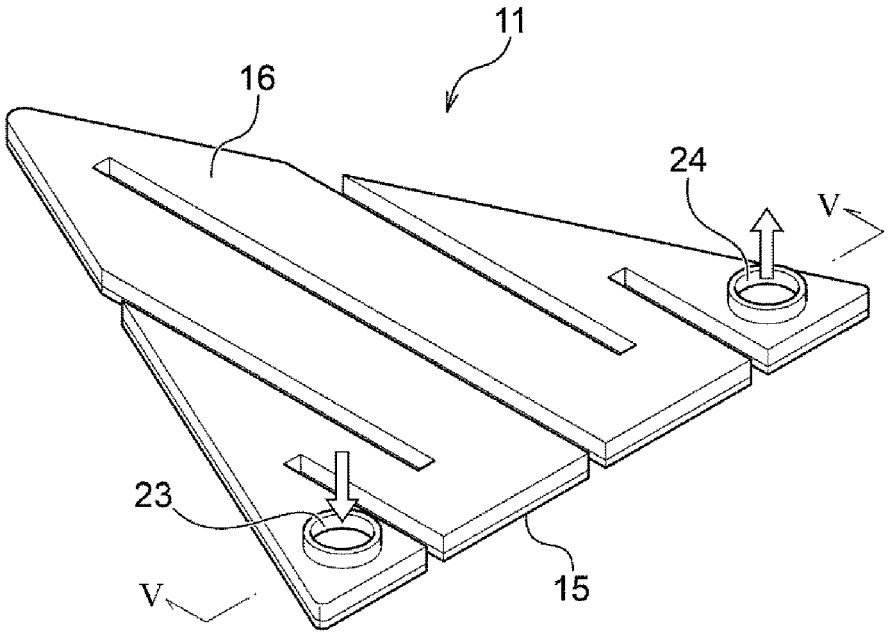
FIG. 3 is a perspective view illustrating the pad contact member of the exemplary embodiment illustrated in FIGS. 1 and 2.

FIG. 3 is a perspective view illustrating the pad contact member 11 of the exemplary embodiment illustrated in FIGS. 1 and 2. As illustrated in FIG. 3, the pad contact member 11 having a triangular shape in plan view includes a plate member 15 having a contact surface that comes in contact with the surface of the polishing pad 3, and a flow path forming member 16 having a liquid flow path formed therein. The plate member 15 is fixed to the bottom portion of the flow path forming member 16. A liquid inlet 23 and a liquid outlet 24 are formed on the top surface of the flow path forming member 16.

Figure 4:
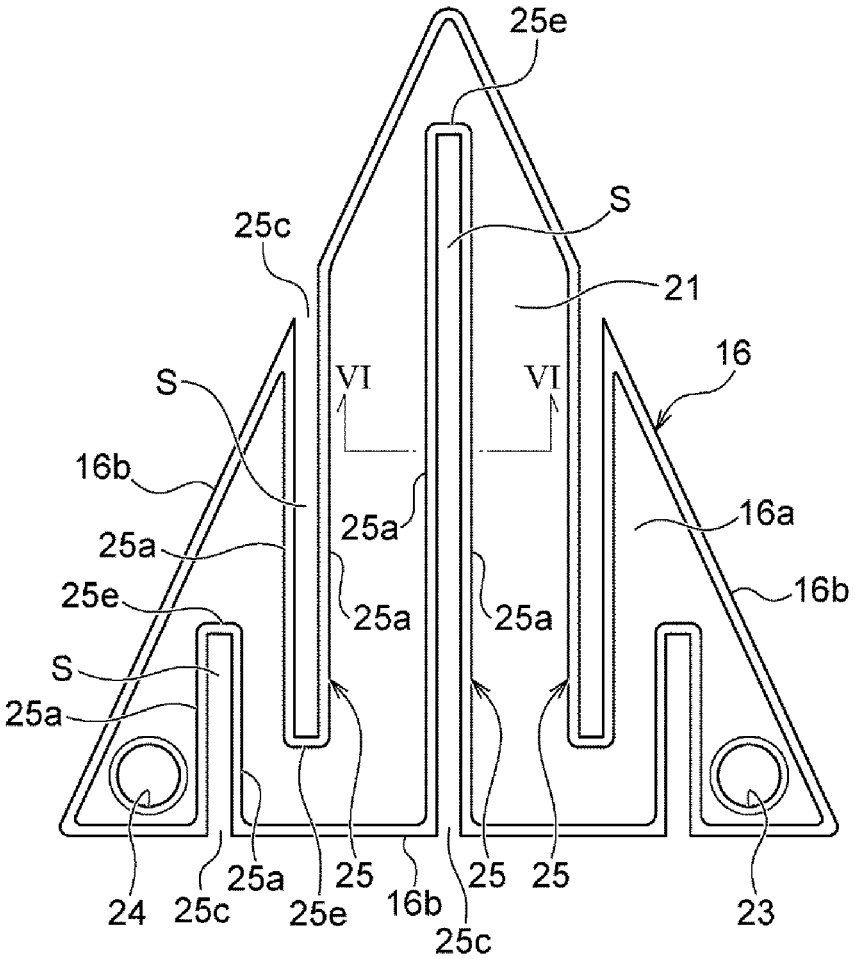
FIG. 4 is a bottom view of a flow path forming member illustrated in FIG. 3.
Figure 5:
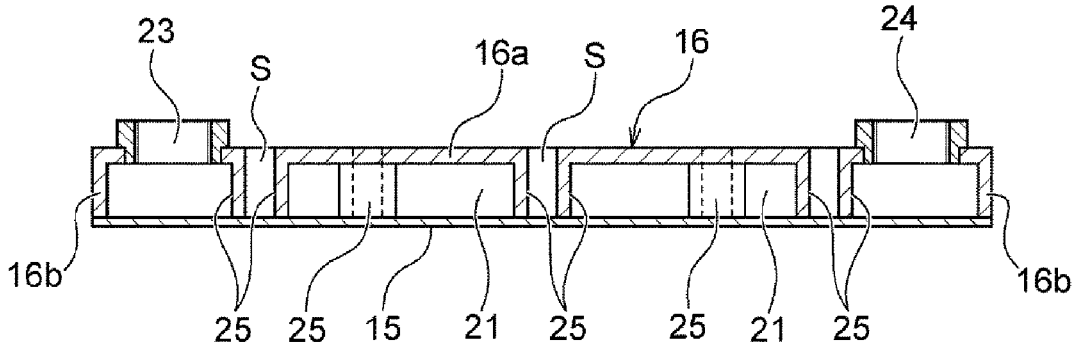
FIG. 5 is a sectional view taken along line V-V in FIG. 3.

FIG. 4 is a bottom view of the flow path forming member 16 illustrated in FIG. 3. FIG. 5 is a sectional view taken along line V-V in FIG. 3. As illustrated in FIGS. 4 and 5, the flow path forming member 16 includes a flat plate 16*a* having a triangular shape in a plan view, and three (3) side walls 16*b* vertically extending from the outer peripheral edges of the triangular flat plate 16*a*, and has a vessel shape as a whole. A liquid flow path 21 is formed inside the flow path forming member 16. The start end of the liquid flow path 21 is communicated with the liquid inlet 23, and the terminal end of the liquid flow path 21 is communicated with the liquid outlet 24.

The liquid from the liquid supply tank 31 of the liquid supply system 30 is supplied to the liquid flow path 21 via the liquid inlet 23. The liquid flows in the liquid flow path 21, and heat exchange is performed between the liquid and the polishing pad 3. After flowing in the liquid flow path 21, the liquid is discharged from the liquid outlet 24 and returned to the liquid supply tank 31 of the liquid supply system 30.

A plurality of (five (5) in the example illustrated in FIG. 4) baffles (ribs) 25 is arranged within the liquid flow path 21. The baffles 25 include baffles extending from the bottom side to any of the oblique sides of the triangular shape in a plan view, and baffles extending from any of the oblique sides to the bottom side of the triangular shape, and the baffles are arranged in parallel with each other. The baffles 25 are arranged to be alternately staggered, by which the liquid flow path 21 forms a zigzag flow path. The baffles 25 extend in the radial direction of the polishing table 2, and the liquid within the liquid flow path 21 alternately advances toward the center of the polishing table 2 and toward the outer circumference of the polishing table 2.

Figure 6:
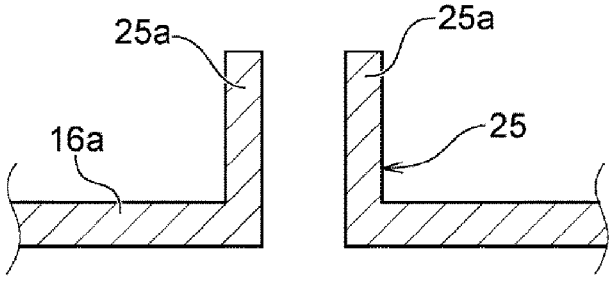
FIG. 6 is a sectional view taken along line VI-VI in FIG. 4, illustrating the details of baffles.

FIG. 6 is a sectional view taken along line VI-VI in FIG. 4, illustrating the details of the baffles 25. As illustrated in FIG. 6, each of the baffles 25 is formed by two (2) plates 25*a*, 25*a* extending from the flat plate 16*a* in the vertical direction, and the two plates 25*a*, 25*a* are arranged in parallel with each other. As illustrated in FIG. 4, one ends of the two plates 25*a*, 25*a* in each baffle 25 are connected to a side wall 16*b*, and in the connected portion, an opening (or a gap) 25*c* is formed between the two plates 25*a*, 25*a*. In addition, the other ends of the two plates 25*a*, 25*a* are connected to each other to form a closed portion 25*e*. Accordingly, between two plates 25*a*, 25*a* in each baffle 25, a space S is formed which is communicated to the surrounding atmosphere of the pad contact member 11.

The plate member 15 is formed by depositing SiC in a plate shape through a chemical vapor deposition (CVD). By using the CVD technique, it is possible to form a thin plate member 15. For example, the plate member 15 illustrated in FIGS. 3 and 5 has a thickness in a range of about 0.7 mm to about 1.0 mm. The SiC formed through the CVD is excellent in heat conductivity as compared to a sintered SiC. Accordingly, when the thin SiC plate member 15 formed through CVD is used, the heat exchange efficiency between the liquid and the polishing pad 3 can be enhanced. Meanwhile, in the view point of, for example, manufacturing costs, the plate member 15 may be formed of a sintered SiC. Even in this case, it is desirable to form the plate member 15 as thin as possible. For example, the thickness of the plate member 15 formed of a sintered SiC may be about 1.0 mm.

The flow path forming member 16 is formed of ceramic. The flow path forming member 16 is in the shape of a vessel having a lower end opening, which is closed by the plate member 15. The side walls 16*b* of the flow path forming member 16 and the plate member 15 are bonded to each other by an adhesive. As the adhesive, frit glass may be used. The frit glass is an adhesive based on a glass bonding technique, and is able to bond ceramic and SiC to each other. The coefficient of linear expansion of the frit glass is substantially the same as those of ceramic and SiC, and thus, when the frit glass is used, it is possible to suppress thermal stress.

By the heat of the liquid flowing in the pad contact member 11, the flow path forming member 16 and the plate member 15 are deformed to a certain extent. In order to make the effect of the heat expansion as small as possible, the ceramic forming the flow path forming member 16 may have the coefficient of linear expansion that is substantially the same as SiC forming the plate member 15.

The plate member 15 is also bonded to the plurality of baffles 25, in addition to the side walls 16*b* of the flow path forming member 16. That is, the plate member 15 is bonded to the lower ends of each side wall 16*b* and each baffle 25 in the flow path forming member 16 by the adhesive. Accordingly, the mechanical strength of the thin plate member 15 is reinforced so as to suppress the deformation of the plate member 15 by the pressure of the liquid. As the plate member 15 is supported by the plurality of baffles 25 as described above, a thinner plate member 15 can be used, and as a result, the heat exchange efficiency can be increased.

The above-mentioned liquid inlet 23 and liquid outlet 24 are formed in the flow path forming member 16. Both the liquid inlet 23 and the liquid outlet 24 are positioned above the outer circumference of the polishing pad 3. The liquid inlet 23 is positioned at the downstream side of the liquid outlet 24 in relation to the rotating direction of the polishing table 2 (polishing pad 3). This is to improve the heat exchange efficiency between the liquid and the polishing pad 3 by making the liquid flow in the opposite direction to the rotating direction of the polishing pad 3. The liquid flow path 21 is formed in a zigzag by the plurality of baffles 25, but extends in the radial direction of the polishing pad 3 as a whole. Accordingly, the liquid advances in the radial direction of the polishing pad 3 while meandering in the liquid flow path 21.

Because the polishing pad 3 rotates about the center thereof during the polishing of the substrate, the temperature of the portion at the outer circumference side of the polishing pad 3 becomes lower than that of the portion at the center side of the polishing pad 3. For this reason, a temperature gradient exists on the surface of the polishing pad 3 during the polishing along the radial direction thereof. It is desirable to eliminate the temperature gradient of the polishing pad 3 because the temperature gradient may adversely affect the polishing of the substrate. Thus, in order to eliminate the temperature gradient of the polishing pad 3, the width of the pad contact member 11 is gradually reduced toward the center of the polishing table 2 (polishing pad 3).

Figure 7:
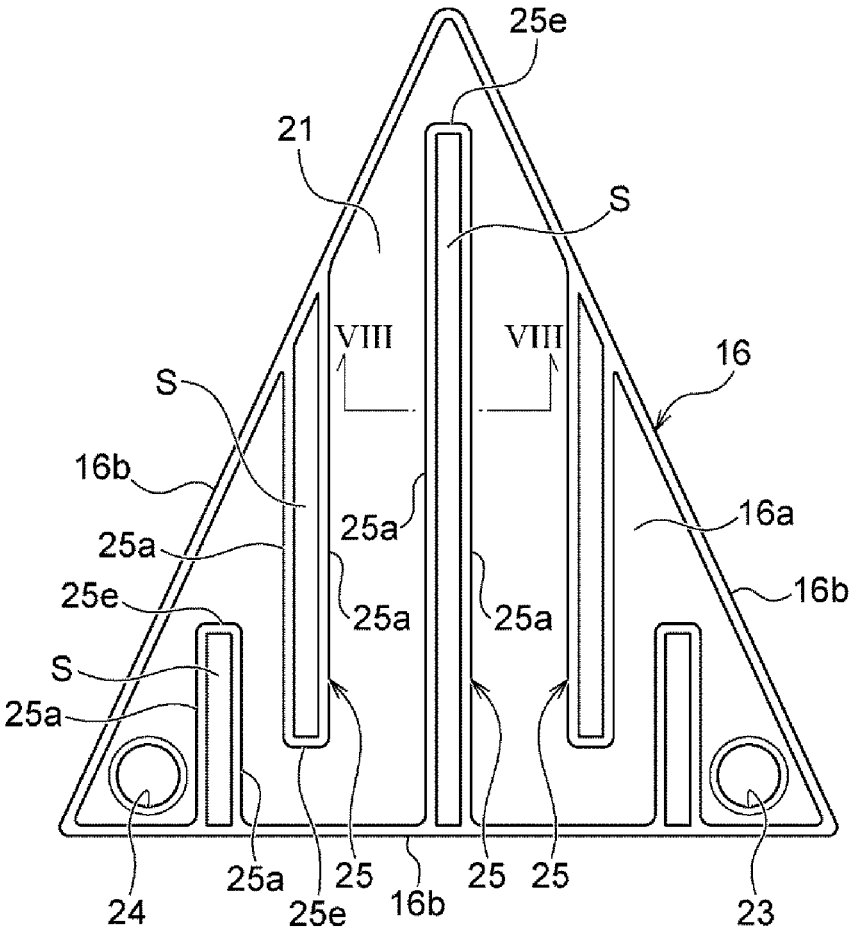
FIG. 7 is a bottom view of a flow path forming member, illustrating a pad contact member of another exemplary embodiment.
Figure 8:
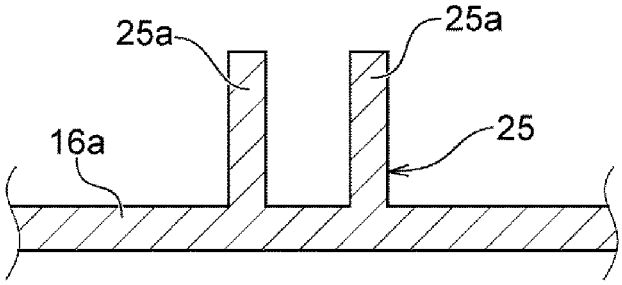
FIG. 8 is a sectional view taken along line VIII-VIII in FIG. 7.

FIGS. 7 and 8 are views illustrating another exemplary embodiment of the pad contact member. FIG. 7 is a bottom view of the flow path forming member 16, and corresponds to FIG. 4. FIG. 8 is a sectional view taken along line VIII-VIII in FIG. 7, and corresponds to FIG. 6.

As illustrated in FIG. 7, the flow path forming member 16 includes a flat plate 16*a* having a triangular shape in plan view, and three (3) side walls 16*b* vertically extending from the outer peripheral edges of the triangular flat plate 16*a*, and has a vessel shape as a whole. In the example illustrated in FIG. 7, an opening (or a gap) is not formed in the side walls 16*b*. A liquid flow path 21 is formed inside the flow path forming member 16. The start end of the liquid flow path 21 is communicated with the liquid inlet 23, and the terminal end of the liquid flow path 21 is communicated with the liquid outlet 24.

As illustrated in FIG. 8, each of the baffles 25 is formed by two (2) plates 25*a*, 25*a* extending from the flat plate 16*a* in the vertical direction, and the two plates 25*a*, 25*a* are arranged in parallel with each other. As illustrated in FIG. 7, one ends of the two plates 25*a*, 25*a* in each baffle 25 are connected to a side wall 16*b*. In addition, the other ends of the two plates 25*a*, 25*a* are connected to each other to form a closed portion 25*e*. Accordingly, a space S is formed in each baffle 25 by the two plates 25*a*, 25*a* in each baffle 25, a closed portion 25*e*, and a portion of the side wall 16*b*.

The plate member, which closes the lower end opening of the flow path forming member 16 illustrated in FIGS. 7 and 8, has the same configuration as the plate member 15 illustrated in FIGS. 3 and 5. Accordingly, the pad contact member 11, which is formed by closing the lower end opening of the flow path forming member 16 illustrated in FIGS. 7 and 8 by the plate member 15, has a closed space S within each baffle 25. The other configuration is the same as that of the pad contact member 11 illustrated in FIGS. 3 to 6.

Figure 9A:
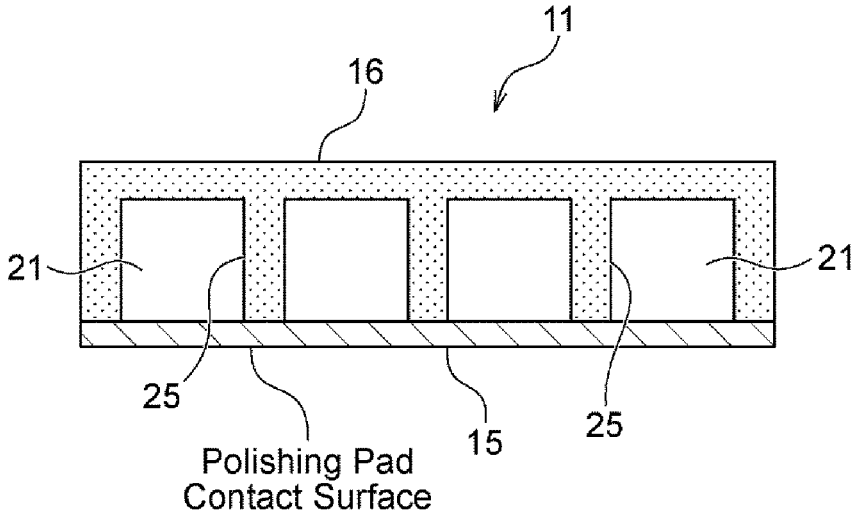
Figure 9B:
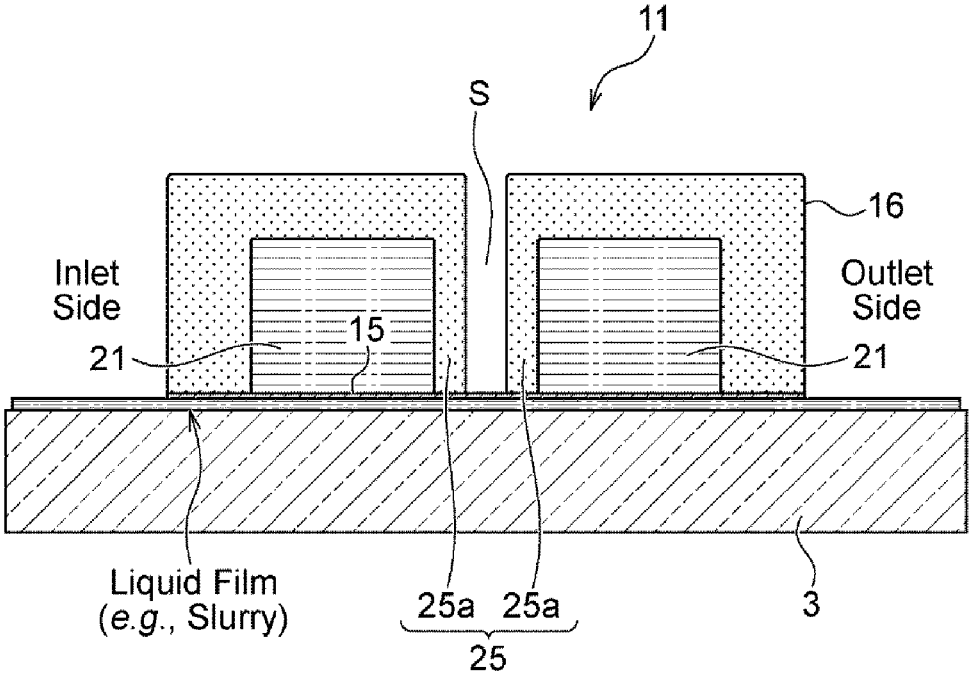

FIGS. 9A and 9B are views illustrating a pad contact member of a comparative example and a pad contact member of the present disclosure in comparison, in which FIG. 9A is a schematic view illustrating a pad contact member of the comparative example, and FIG. 9B is a schematic view illustrating the pad contact member of the present disclosure illustrated in FIGS. 3 to 6.

The pad contact member 11 of the comparative example illustrated in FIG. 9A is formed by bonding a plate member 15 and a flow path forming member 16, in which the flow path forming member 16 is made of a material having a relatively low heat conductivity (e.g., steel use stainless (SUS) or a resin), and the plate member 15 is made of a material having a relatively high heat conductivity (e.g., SiC). A plurality of baffles 25 is arranged within the liquid flow path 21. In the pad contact member 11 illustrated in FIG. 9A, there is a problem in that, due to the difference in coefficient of linear expansion between the plate member 15 and the flow path forming member 16, a warpage occurs in the pad contact member 11 and a portion floating from the polishing pad occurs, which make the heat transfer efficiency poor. For example, there is also a problem in that the heat transfer to the polishing pad side through the baffles 25 is disturbed by the thermal resistance of the bonding portion.

In the pad contact member 11 of the present disclosure illustrated in FIG. 9B, adjacent flow paths are partitioned, except for the ends thereof, by the baffles 25 installed within the liquid flow path 21, thereby forming a zigzag flow path. A space S is formed between two plates 25*a*, 25*a* that form the baffles 25. The space S is communicated with the surrounding atmosphere of the pad contact member 11. Because the inside of the housing of the polishing apparatus illustrated in FIG. 1 is filled with air, the space S is filled with air. The air within the space S of the baffles 25 may form a heat insulation layer so as to suppress heat from moving between the adjacent flow paths across the baffles 25, thereby suppressing the unnecessary movement of heat. In addition, because the plate member 15 and the flow path forming member 16 have coefficients of linear expansion which are substantially equal to each other, no warpage occurs in the pad contact member 11. Accordingly, the problems of the degradation of the heat transfer efficiency, the thermal resistance in the bonding portion, and so on in the pad contact member 11 of the comparative example do not exist in the pad contact member 11 of the present disclosure.

Figure 10:
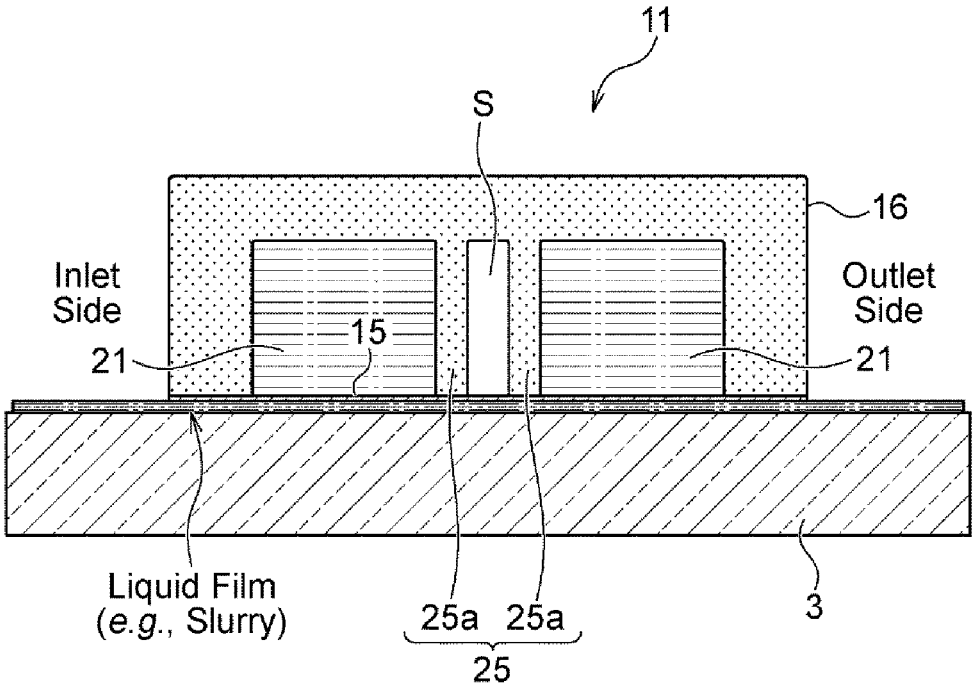
FIG. 10 is a schematic view illustrating the pad contact member of the present disclosure illustrated in FIGS. 7 and 8.

FIG. 10 is a schematic view illustrating the pad contact member 11 of the present disclosure illustrated in FIGS. 7 and 8. The pad contact member 11 of the present disclosure illustrated in FIG. 10, adjacent flow paths are partitioned, except for the ends thereof, by the baffles 25 installed within the liquid flow path 21, thereby forming a zigzag flow path. A closed space S is formed between two plates 25*a*, 25*a* that form the baffles 25. The closed space S is evacuated to form a vacuum. The vacuum within the closed space S may form a heat insulation layer so as to suppress heat from moving between the adjacent flow paths across the baffles 25, thereby suppressing the unnecessary movement of heat. The heat transfer within the member may be suppressed by reducing the thicknesses of the top and bottom portions of the closed space S as much as possible. Meanwhile, the heat insulation layer may be formed by enclosing a gas in the closed space S.

Figure 11:
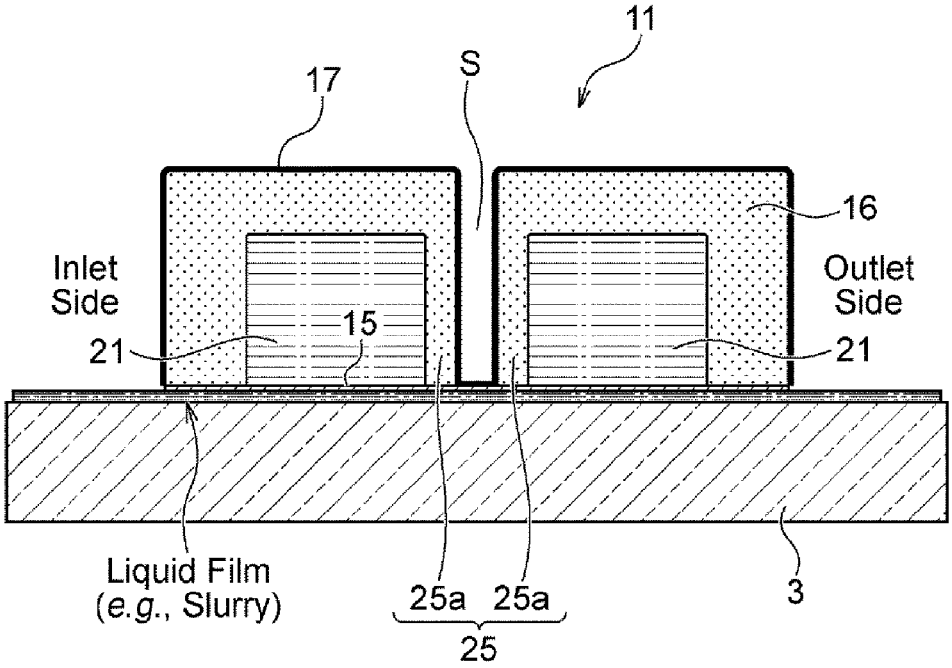
FIG. 11 is a schematic view illustrating an exemplary embodiment configured to suppress heat dissipation caused by radiation by attaching a material having a low emissivity to the pad contact member of the present disclosure illustrated in FIG. 9B.

FIG. 11 is a schematic view illustrating an exemplary embodiment configured to suppress heat dissipation caused by radiation by attaching a material having a low emissivity to the pad contact member 11 of the present disclosure illustrated in FIG. 9B. As illustrated in FIG. 11, in the present exemplary embodiment, the heat dissipation caused by radiation from the outer surface of the flow path forming member 16 is suppressed by attaching a metal foil 17 of aluminum or the like to the entire outer surface of the flow path forming member 16. The metal such as aluminum is proper as a material for suppressing the heat dissipation caused by radiation because the metal has a low emissivity in a range of 0.1 to 0.04. However, in order to suppress heat transfer through the metal, the metal is formed as a metal foil (having a thickness of several μm) so as to suppress the heat dissipation caused by radiation from the outer surface of the flow path forming member 16.

Figure 12:
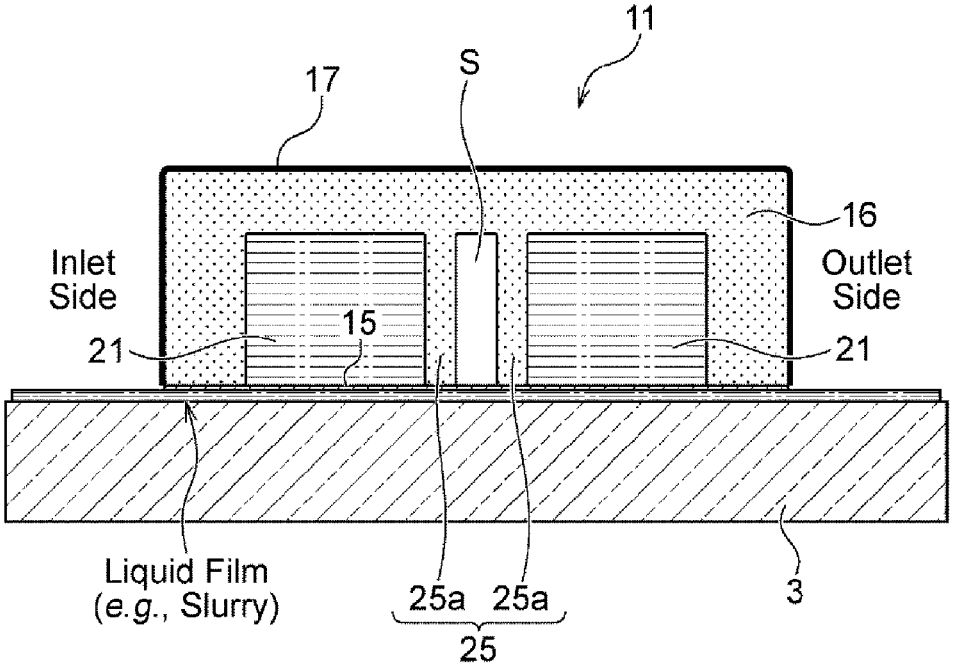
FIG. 12 is a schematic view illustrating an exemplary embodiment configured to suppress heat dissipation caused by radiation by attaching a material having a low emissivity to the pad contact member of the present disclosure illustrated in FIG. 10.

FIG. 12 is a schematic view illustrating an exemplary embodiment configured to suppress heat dissipation caused by radiation by attaching a material having a low emissivity to the pad contact member 11 of the present disclosure illustrated in FIG. 10. As illustrated in FIG. 12, in the present exemplary embodiment, the heat dissipation caused by radiation from the outer surface of the flow path forming member 16 is suppressed by attaching a metal foil 17 of aluminum or the like to the entire outer surface of the flow path forming member 16.

Figure 13:
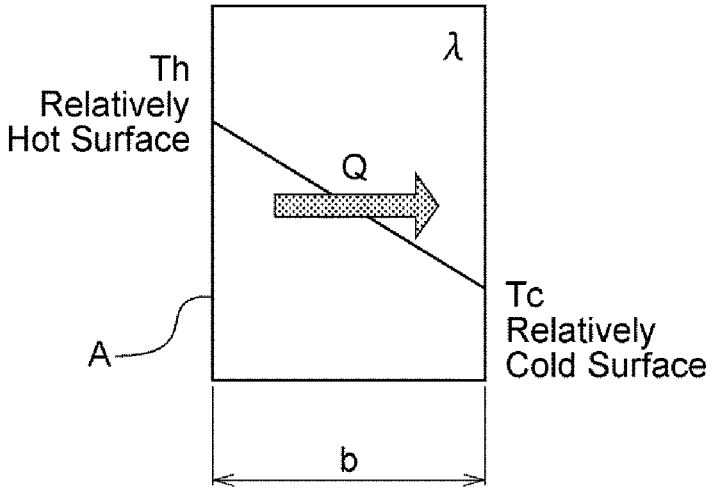
FIG. 13 is a schematic view illustrating a case in which heat moves in a flat plate having a predetermined thickness.

Next, the configuration of the pad contact member 11 of the present disclosure will be described based on a heat transfer theory. FIG. 13 is a schematic view illustrating a case in which heat moves in a flat plate having a predetermined thickness. In a case where a flat plate has a heat transfer area A, a thickness B, and a heat conductivity λ, the left surface of the flat plate is maintained at a relatively hot temperature Th, and the right surface of the flat plate is maintained at a relatively cold temperature Tc, the heat quantity Q normally moving from a relatively hot surface to a relatively cold surface in the flat plate is given by Equation 1.

Equation 1

$$Q = A\lambda \frac{Th - Tc}{b} \quad (1)$$

Assuming that the flat plate illustrated in FIG. 13 is the baffle 25 in the pad contact member 11 of the present disclosure, it can be seen from Equation 1 that the heat quantity Q moving from the relatively hot surface to the relatively cold surface can be reduced when the thickness b of the baffle 25 is increased.

However, assuming that the size (dimension) of the pad contact member 11 is the same without being changed, increasing the thickness b of the baffle 25 means that the cross-sectional area of the liquid flow path 21 is reduced, and the heat quantity transferred to the polishing pad 3 from the liquid within the liquid flow path 21 will be reduced. Accordingly, it can be seen from Equation 1 that the measure of increasing the thickness b of the baffle 25 in order to reduce the heat quantity Q moving through the baffle 25 is not desirable.

Figure 14:
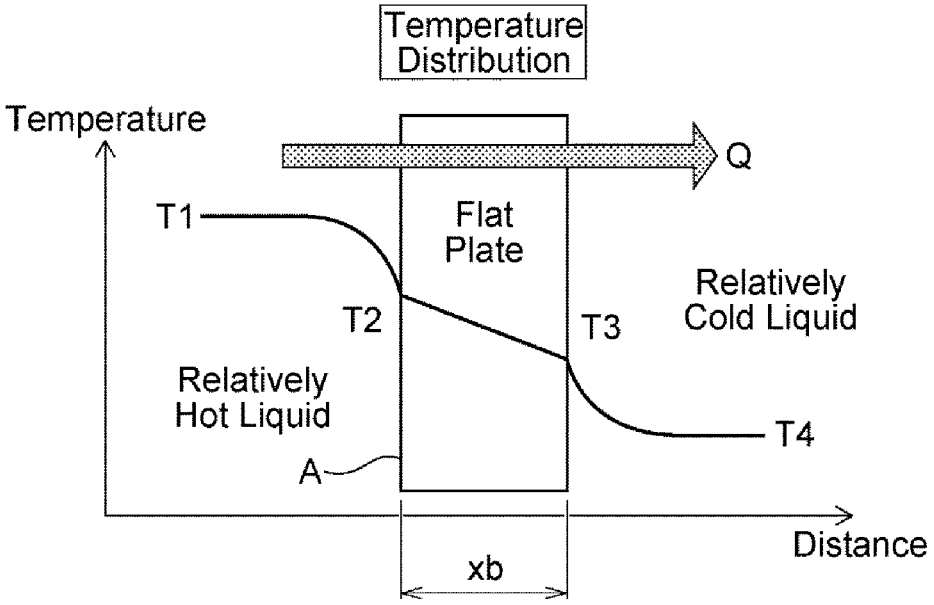
FIG. 14 is a schematic view illustrating a case in which a heat exchange is performed between a relatively hot liquid and a relatively cold liquid across a flat plate having a predetermined thickness.

FIG. 14 is a schematic view illustrating a case in which a heat exchange is performed between a relatively hot liquid and a relatively cold liquid across a flat plate having a predetermined thickness.

In a case where a relatively hot liquid having a temperature T1 performs a heat exchange with a relatively cold liquid having a temperature T4 through a flat plate having a heat transfer area A, a thickness xb, and a heat conductivity λ, a heat quantity Q normally moving from the relatively hot liquid to the relatively cold liquid is given by Equation 2. Here, it is assumed that T1 is a temperature of the relatively hot liquid, T2 is a surface temperature (at the relatively hot liquid side) of the flat plate, T3 is a surface temperature (at the relatively cold liquid side) of the flat plate, T4 is a temperature of the relatively cold liquid, and T1>T2>T3>T4. In addition, ha is a heat transfer rate between the relatively hot liquid and the flat plate, λb is a thermal conductivity of the flat plate, and hc is a heat transfer rate between the relatively cold liquid and the flat plate.

Equation 2

$$Q = A \cdot ha(T1 - T2) = A \cdot \frac{\lambda b}{xb}(T2 - T3) = A \cdot hc(T3 - T4) = \frac{A(T1 - T4)}{\frac{1}{ha} + \frac{xb}{\lambda b} + \frac{1}{hc}} \quad (2)$$

Assuming that the flat plate illustrated in FIG. 14 is the baffle 25 in the pad contact member 11 of the present disclosure, it can be seen from Equation 2 that the heat quantity Q moving from the relatively hot liquid to the relatively cold liquid can be reduced when the area A of the baffle 25 to be in contact with the relatively hot liquid is reduced.

However, assuming that the size (dimension) of the pad contact member 11 is the same without being changed, reducing the area A of the baffle 25 to be in contact with the relatively hot liquid will reduce the area surrounding the liquid flow path 21, and as a result, the heat quantity transferred to the polishing pad 3 from the baffle 25 will be reduced. Accordingly, it can be seen from Equation 2 that the measure of reducing the area A of the baffle 25 in order to reduce the heat quantity Q moving through the baffle 25 from the relatively hot liquid to the relatively cold liquid is not desirable.

As described above, based on Equations 1 and 2, a space S forming an heat insulation layer is formed in the baffle 25 in the pad contact member 11 of the present disclosure in order to reduce the heat quantity Q moving from the relatively hot liquid side to the relatively cold liquid side through the baffle 25 without increasing the thickness b of the baffle 25 and reducing the area A of the baffle 25 to be in contact with the liquid. The space S is filled with a gas or evacuated to form a vacuum, and is formed as a heat insulation layer that suppresses heat transfer. An example of the gas filled in the space S may be air.

Figure 15:
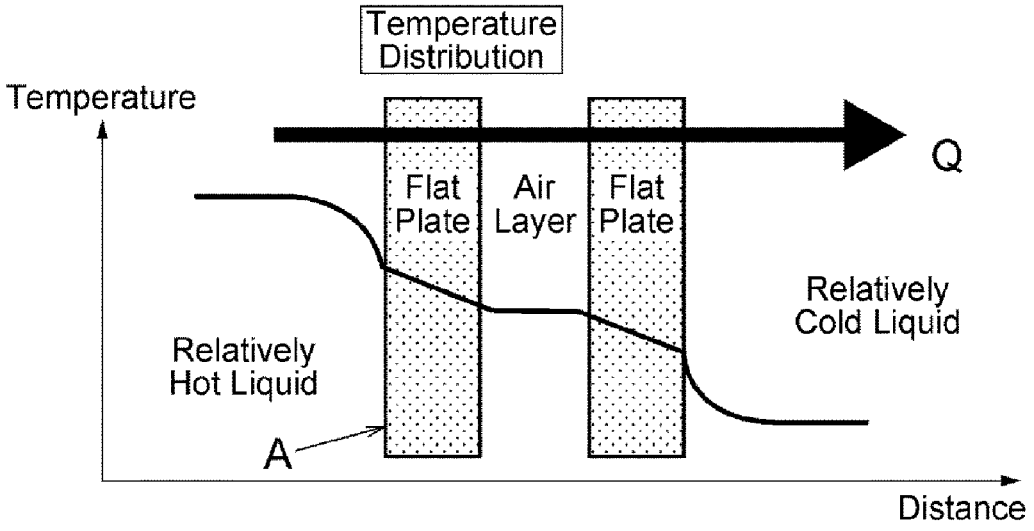
FIG. 15 is a schematic view illustrating a heat insulation effect in a case where a thin gas layer is formed between flat plates.

FIG. 15 is a schematic view illustrating a heat insulation effect in a case where a thin gas layer is formed between flat plates. Hereinafter, descriptions will be made assuming that the gas layer is an air layer.

When a thin air layer is formed between the flat plates, it is believed that the temperature in the air layer portion in FIG. 14 is constant assuming that the convection or flow of the air itself hardly exists due to the thin air layer. That is, because the heat transfer of the air layer is negligible, the air layer may be considered as a portion of the flat plate. The heat conductivity of air is generally about 0.02 W/mk, which is very small as compared to stainless steel (about 20 W/mk) or SiC (about 200 W/mk). That is, it can be said that air hardly transfers heat.

By forming the thin air layer in the space within the baffle, an effect of reducing the heat quantity Q moving from the relatively hot liquid to the relatively cold liquid, i.e. a heat insulation effect can be obtained.

In the case where the closed space within the baffle is evacuated to form a vacuum, the heat insulation effect can be further expected because the heat transfer is negligible when the temperature difference between the wall surfaces is small although the heat transfer by radiation exists.

Hereinafter, the heat transfer rate of a fluid will be described. The heat transfer rate of a fluid is generally calculated using Equation 3 below.

Equation 3

$$h = k \times Nu/L \quad (3)$$

Here, h is a heat transfer rate of the fluid, k is a heat conductivity of the fluid, Nu is a Nusselt number, and L is a representative length.

As apparent from Equation 3 above, the heat transfer rate of the fluid, h, is proportional to the Nusselt number Nu, and the Nusselt number Nu is a function of a Reynolds number as generally expressed by Equation 4 below.

Equation 4

$$Nu = f(Re, Pr, \ldots) \quad (4)$$

Here, Nu is a Nusselt number, Pr is a Prandtl number, and Re is a Reynolds number.

In addition, the Reynolds number Re is proportional to a flow velocity of a fluid as expressed by Equation 5 below.

Equation 5

$$Re = v \times L/\nu \quad (5)$$

Here, Re is a Reynolds number, L is a representative length, v is a relative velocity of the fluid, and v is a dynamic viscosity coefficient of the fluid.

That is, it can be said that the heat transfer rate h of the fluid is a function of the flow velocity of the fluid. Accordingly, when the fluid is stopped, the heat transfer rate is approximately zero. In particular, in a case of a fluid within a closed space, the heat transfer rate may be considered approximately zero because the fluid flows only by natural convection due to gravity and the velocity thereof is small.

By forming a gas layer (air layer) in the space within the baffle by using the characteristic of the heat transfer rate of a fluid described above, the heat insulation effect of the baffle can be obtained.

Figure 16B:
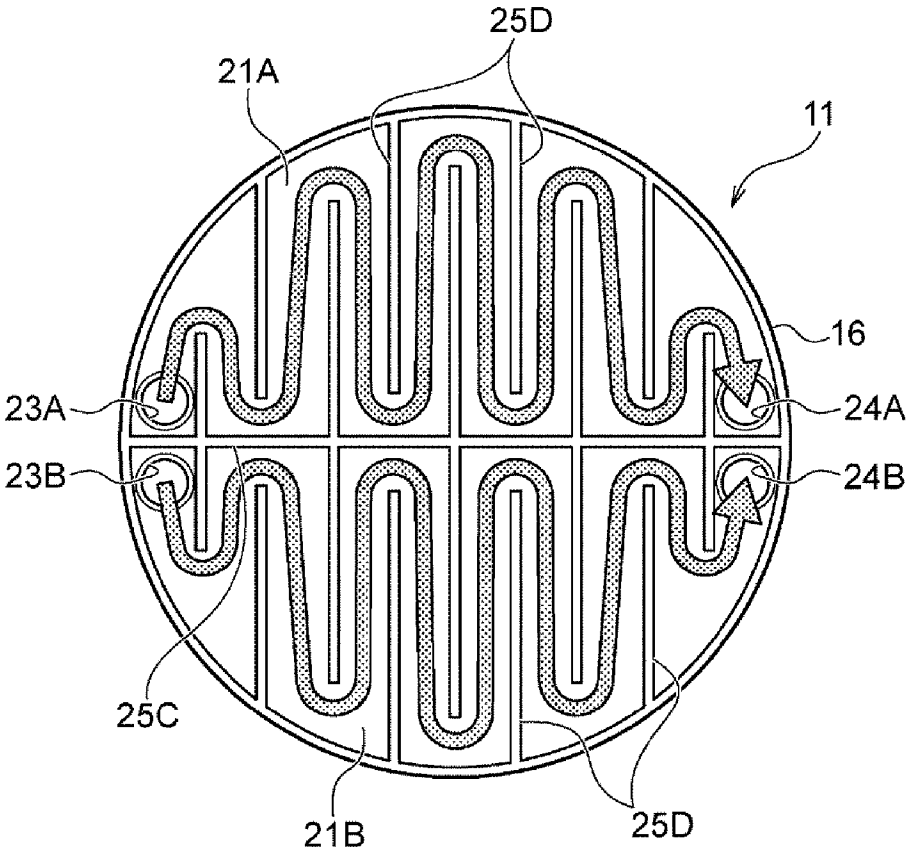
FIGS. 16A and 16B are schematic views illustrating pad contact members of other exemplary embodiments of the present disclosure, respectively.
Figure 16A:
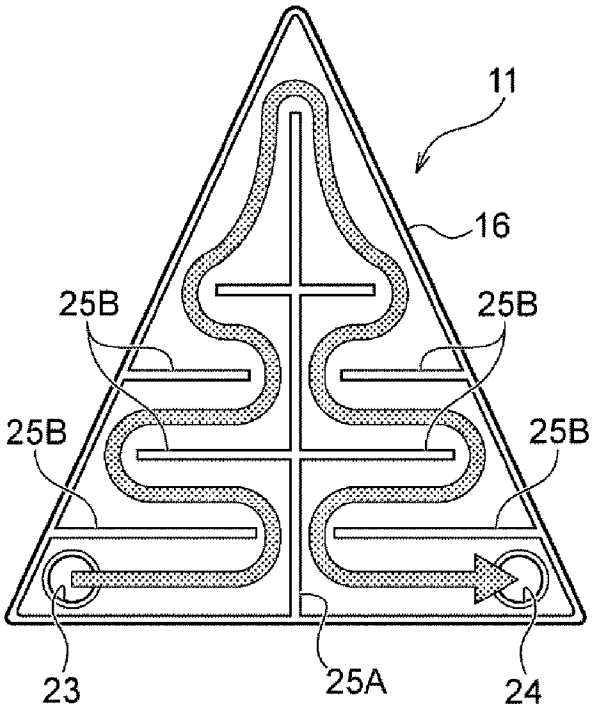

FIGS. 16A and 16B are schematic views illustrating pad contact members 11 of other exemplary embodiments of the present disclosure. Meanwhile, FIGS. 16A and 16B are plan views of the pad contact members 11, respectively, in which the baffles within the liquid flow paths are illustrated by solid lines, and the flows of the liquid within the liquid flow paths are illustrated by arrows.

In the pad contact member 11 illustrated in FIG. 16A, a central baffle 25A is arranged in the inner liquid flow path 21 of the flow path forming member 16 to extend from the center of the bottom side of a triangle to the apex of the triangle, and a plurality of baffles 25B is arranged between the central baffle 25A and the oblique sides of the triangle to be in parallel with each other and to be alternately staggered. The plurality of baffles 25B is arranged on the left and right of the central baffle 25A to be symmetric to each other, and form two zigzag flow paths that communicate with each other at the end side of the central baffle 25A. In the pad contact member 11 illustrated in FIG. 16A, as indicated by the arrow, the liquid flowing in from a liquid inlet 23 is adapted to flow out from a liquid outlet 24 through the two zigzag flow paths. Within the baffles 25A and 25B illustrated in FIG. 16A, spaces (not illustrated), which are the same as the spaces S illustrated in FIGS. 3 to 9B, are formed.

In the pad contact member 11 illustrated in FIG. 16B, two flow paths of a relatively hot liquid flow path 21A in which a relatively hot liquid flows and a relatively cold liquid flow path 21B in which a relatively cold liquid flows are arranged within a disc-shaped flow path forming member 16. The relatively hot liquid flow path 21A and the relatively cold liquid flow path 21B are completely separated from each other by a central baffle (or partition) 25C. In addition, in each of the relatively hot liquid flow path 21A and the relatively cold liquid flow path 21B, a plurality of baffles 25D is arranged in parallel with each other and to be staggered from each other, thereby forming a zigzag flow path. In the pad contact member 11 illustrated in FIG. 16B, as indicated by the arrow, the relatively hot liquid flowing in from a liquid inlet 23A is adapted to flow out from a liquid outlet 24A through a zigzag flow path, and the relatively cold liquid flowing in from a liquid inlet 23B is adapted to flow out from a liquid outlet 24B through a zigzag flow path. Within the baffles 25C and 25D illustrated in FIG. 16B, spaces (not illustrated), which are the same as the spaces S illustrated in FIG. 3 to FIGS. 9A and 9B, are formed.

According to the pad contact member 11 illustrated in FIG. 16B, it is possible to suppress the heat from moving between flow paths laid adjacent to each other across the baffle 25C, thereby suppressing the unnecessary movement of heat by forming a space for forming a heat insulation layer in the baffle (or partition) 25C that separates the relatively hot liquid flow path 21A and the relatively cold liquid flow path 21B.

When the surface temperature of the polishing pad 3 is controlled by using the pad contact member 11 illustrated in FIG. 16B, the following two methods may be considered: a first method of disposing the pad contact member 11 on the polishing pad 3 in such a manner in which the baffle (or partition) 25C of the pad contact member 11 is positioned in a radial direction of the polishing pad 3, and a second method of disposing the pad contact member 11 on the polishing pad 3 in such a manner in which the baffle (or partition) 25C of the pad contact member 11 is positioned in a direction orthogonal to the radial direction of the polishing pad 3. In the first method, the region on the polishing pad 3 to be in contact with the pad contact member 11 is controlled to have an intermediate temperature between the temperatures of the relatively hot liquid supplied to the relatively hot liquid flow path 21A and the relatively cold liquid supplied to the relatively cold liquid flow path 21B. In addition, in the second method, the region on the polishing pad 3 to be in contact with the pad contact member 11 is divided into a relatively hot region of which the temperature is controlled by the relatively hot liquid and a relatively cold region of which the temperature is controlled by the relatively cold liquid in the radial direction of the polishing pad 3.

From the foregoing, it will be appreciated that various exemplary embodiments of the present disclosure have been described herein for the purpose of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A polishing apparatus that polishes a substrate, the polishing apparatus comprising:

a polishing table configured to support a polishing pad that polishes the substrate by a sliding contact with the substrate;

a top ring configured to press the substrate against the polishing pad on the polishing table; and a pad temperature control mechanism configured to control a surface temperature of the polishing pad, wherein the pad temperature control mechanism includes a pad contact member that comes in contact with the surface of the polishing pad and a liquid supply system configured to supply a temperature-controlled liquid to the pad contact member, the pad contact member includes a liquid flow path therein communicating with a liquid inlet and a liquid outlet connected to the liquid supply system, at least one baffle is disposed in the liquid flow path, and the baffle is formed by two plates arranged to be substantially parallel with each other with a space therebetween, the space being different from the liquid flow path.

2. The polishing apparatus of claim 1, wherein the space communicates with a surrounding atmosphere of the pad contact member.

3. The polishing apparatus of claim 1, wherein the space is a closed space.

4. The polishing apparatus of claim 3, wherein a gas is enclosed in the closed space.

5. The polishing apparatus of claim 1, wherein a plurality of baffles are arranged in the liquid flow path in parallel with each other.

6. The polishing apparatus of claim 1, wherein a plurality of baffles are alternately staggered from each other in the liquid flow path, and the liquid flow path is formed in a zigzag flow path by the plurality of baffles.

7. The polishing apparatus of claim 1, wherein the pad contact member includes two or more liquid flow path, liquids flowing in the two or more liquid flow paths are controlled to have different temperatures, respectively, and the at least one baffle is disposed to separate the two or more liquid flow paths.

8. The polishing apparatus of claim 1, wherein the pad contact member includes a member configured to suppress heat dissipation caused by radiation from an outer surface of the pad contact member.

9. The polishing apparatus of claim 1, wherein the pad temperature control mechanism further includes a lifting mechanism configured to move the pad contact member up and down, and a moving mechanism configured to move the pad contact member between a predetermined raised position above the polishing pad and a predetermined retracted position radially outside the polishing table.

10. The polishing apparatus of claim 1, wherein the baffle is configured to extend in a radial direction of the polishing table, and the liquid within the liquid flow path alternately advances toward a center of the polishing table and toward an outer circumference of the polishing table.

11. The polishing apparatus of claim 1, wherein both the liquid inlet and the liquid outlet are positioned above an outer circumference of the polishing pad.

12. The polishing apparatus of claim 11, wherein the liquid inlet is positioned at a downstream side of the liquid outlet in relation to a rotating direction of the polishing table.

13. The polishing apparatus of claim 1, wherein a width of the pad contact member is gradually reduced toward a center of the polishing table.

14. A polishing apparatus that polishes a substrate by causing the substrate to be in slide contact with a polishing pad, the polishing apparatus comprising:

a polishing table configured to support the polishing pad;

a top ring configured to press the substrate against the polishing pad on the polishing table; and a pad temperature control mechanism configured to control a surface temperature of the polishing pad, wherein the pad temperature control mechanism includes a pad contact member that comes in contact with the surface of the polishing pad and a liquid supply system configured to supply a temperature-controlled liquid to the pad contact member, the pad contact member includes a liquid flow path therein, the liquid flow path communicates with a liquid inlet and a liquid outlet connected to the liquid supply system, at least one baffle is disposed in the liquid flow path, the baffle has a space therein, the space is a closed space, and the closed space is a vacuum.

* * * * *